US008522420B2

(12) United States Patent
Hong et al.

(10) Patent No.: US 8,522,420 B2
(45) Date of Patent: Sep. 3, 2013

(54) MANUFACTURE OF HIGH TEMPERATURE SUPERCONDUCTOR COILS

(75) Inventors: Seung Hong, New Providence, NJ (US); Hanping Maio, Edison, NJ (US); Huang Yibing, Edison, NJ (US); Maarten Meinesz, Parlin, NJ (US); Michael Field, Jersey City, NJ (US)

(73) Assignee: Oxford Superconducting Technology, Inc., Carteret, NJ (US)

( * ) Notice: Subject to any disclaimer, the term of this patent is extended or adjusted under 35 U.S.C. 154(b) by 621 days.

(21) Appl. No.: 12/215,384

(22) Filed: Jun. 26, 2008

(65) Prior Publication Data

US 2009/0325809 A1 Dec. 31, 2009

(51) Int. Cl.
*H01F 41/04* (2006.01)
*H01B 12/06* (2006.01)

(52) U.S. Cl.
USPC ..... 29/599; 174/125.1; 505/470

(58) Field of Classification Search
USPC ..... 29/599; 174/125.1; 505/470
See application file for complete search history.

(56) References Cited

U.S. PATENT DOCUMENTS

| | | | | |
|---|---|---|---|---|
| 5,531,015 | A * | 7/1996 | Manlief et al. | 29/599 |
| 5,902,774 | A | 5/1999 | Muranaka et al. | |
| 6,344,430 | B1 | 2/2002 | Duperray et al. | |
| 6,746,991 | B2 * | 6/2004 | Rey et al. | 505/470 |

OTHER PUBLICATIONS

Miao, et al, IEEE Transactions on Applied Superconductivity (2007) 17(2): 2262-2265.
Markiewicz, et al, IEEE Trans. on Appl. Supercond. 2006; 16(2): 1523-1526.
Watanabe, et al., Advances in Cryo Engineering, 2007; 54: 439-444.

* cited by examiner

*Primary Examiner* — Livius R Cazan
(74) *Attorney, Agent, or Firm* — Klauber & Jackson LLC

(57) ABSTRACT

A method for successfully heat treating magnet coils of braided $Bi_2Sr_2Ca_1Cu_2O_x$ (Bi-2212) strand. The Bi-2212 coil is fabricated using standard round wire powder-in-tube techniques, and braided with a ceramic-glass braid with integrated carbonaceous binder. The coil is heated in an atmosphere controlled furnace below the high current density phase reaction sequence to burn off the carbonaceous binder and evacuated to remove unwanted gases from the inner windings. The oxygen environment is then reintroduced and the coil is heat treated to the high $J_c$ reaction temperature and then processed as normal. As the local atmosphere around the surface of the wire, particularly the concentration of oxygen, is critical to a successful reaction sequence, high current Bi-2212 coils can thereby be obtained.

22 Claims, 3 Drawing Sheets

MANUFACTURE OF HIGH TEMPERATURE SUPERCONDUCTOR COILS

FIELD OF INVENTION

This invention relates generally to superconducting materials and processes for their manufacture, and more specifically relates to the manufacture of high temperature superconducting coils with electrical insulation.

BACKGROUND OF INVENTION

The most important technological value of the high superconducting transition temperature superconductor $Bi_2Sr_2CaCu_2O_x$ (referred to herein as "Bi-2212") may be as a round wire operated at "low temperatures", i.e. 4.2K. That is because Bi-2212 is the only superconductor that can carry a significant supercurrent in the technologically useful form of a round wire in very high magnetic fields, i.e. above 23 Tesla (T). As high field uses inevitably involve construction of some form of coil, reliable Bi-2212 coil manufacture procedures are needed to maximize the potential of this material.

The coil fabrication technology used for the present high field superconductor material, $Nb_3Sn$, is called the "wind-and-react" process, e.g., Taylor et al., "A $Nb_3Sn$ dipole magnet reacted after winding," IEEE Trans. Magnetics Vol. MAG-21, No. 2, 1985, pp. 967-970. Typically a $Nb_3Sn$ precursor composite, either Nb filaments and Sn sources in a Cu matrix, or Nb filaments in a bronze matrix, is wiredrawn to a final diameter ~1 mm and insulated with a glass yarn braid impregnated with a carbonaceous binder such as an organic resin. This wire is wound onto a coil former and heat-treated first to a temperature to burn off the carbonaceous binder, and then to the $Nb_3Sn$ formation temperature. This is typically done by burning the binder in air or oxygen at a relatively low temperature (~300° C.) compared to the $Nb_3Sn$ reaction heat treatment temperature (~650° C.). Any carbon that remains trapped within the windings after the binder is burned has no effect on the $Nb_3Sn$ phase formation.

It is very desirable to adopt this "wind-and-react" process for Bi-2212 coil fabrication, but in practice this has been difficult. The type of glass braid used for $Nb_3Sn$ coils fully melts at the reaction temperatures needed for Bi-2212 coils, so some combination of glass and ceramic, or pure ceramic is needed as the insulation material. Prior art Bi-2212 coils are plagued with many defects amongst the internal windings after reaction. The defects are often visually indicated by black stains (see Denis Markiewicz et al., "Perspective on a Superconducting 30 T/1.3 GHz NMR Spectrometer Magnet," IEEE Trans. on Appl. Supercond., Vol 16, No. 2, 2006, pp. 1523-1526), and the defects result in coils delivering a fraction of the current they should be producing based on short sample testing. These coils are typically heat-treated in a furnace with continuous oxygen gas flow. The carbonaceous binder, known in the paper industry as "sizing," is converted to $CO_2$ during an initial low temperature heat treatment. The $CO_2$ can be trapped in the tight winding pack, and even with a continuous flow of oxygen it is not possible to purge this trapped $CO_2$ gas out of such a tightly wound pack. This presents a major problem, as the atmosphere adjacent to the wire surface is critical to the formation of the optimal phase of Bi-2212. The insulated wire is packed very densely into the coil former with the gas path in and out of coil pack only a series of many small orifices. It is very difficult to remove any unwanted gas, such as what might be produced from burning the binder, through such small orifices. A simple oxygen gas purge does not flush out the residual gas contaminants deep in the winding. One cause of a coil not carrying the expected current is the improper or incomplete formation of Bi-2212 due to contaminated atmosphere in even a small section of the coil during the reaction (high temperature) heat-treatment. Even if this only happens in a small section deep inside of the winding, the extracting and testing of the failed section from the coil is impractical as it may be only a short section of many thousands of meters.

One prior art investigator attempted to overcome this problem by using oxidized Hastelloy fibers as insulation material and a highly gapped weave, but the coil current was only 67% of the short sample (an uninsulated, uncoiled reference sample of the same wire) value. Watanbe, et al, "Ag-Sheated $Bi_2Sr_2CaCu_2O_8$ Square Wire Insulated with Oxidized Hastelloy Fiber Braid", Advances in Cryo Engineering, Vol. 54, 2007, pp. 439-444. In addition, such a thin weave is not practical, in that such materials are both difficult to apply industrially and such wide gaps are highly susceptible to electrical shorting.

SUMMARY OF INVENTION

The present invention overcomes the problems above. In the present invention a round wire of Bi-2212 is manufactured as per the standard round wire powder-in-tube packing and wire drawing techniques (See Hasegawa et al, "HTS Conductors for Magnets", IEEE Trans. on Appl. Supercond., Vol 12, No. 1, 2002, pp. 1136-1140), and then braided with a ceramic-glass yarn. The carbonaceous binder in the yarn is completely burned at a temperature lower than Bi-2212 partial melting point. This produces a byproduct of $CO_2$ and other contaminants that are outgassed from the surface of other parts in the coil. After cooling the vessel to or approximately to room temperature, the $CO_2$ and other contaminate gases are removed by evacuating the heat-treatment chamber containing the coil. After evacuation, the chamber is back-filled with pure oxygen gas or a desired mixture of gases. In this way all the contaminant gases are removed from the winding pack through the small orifices and completely replaced with the desired gas even in the most inaccessible areas in the winding. As the local atmosphere around the surface of the wire, particularly the concentration of oxygen, is critical to reaction sequence, high current Bi-2212 coils can now be obtained.

The process of burning of the binder insulation thus occurs by first evacuating the chamber of the initial furnace gas, which may be nitrogen, air, $CO_2$, or some combination thereof, and then back-filling with a gas with oxygen, followed by the burning procedure at elevated temperature. The temperature is reduced to about room temperature and then the vessel is evacuated to remove the gaseous combustion products. The evacuation, refill with oxygen and burn-off cycle can be repeated one or more times. The back filling of oxygen can initially be of oxygen of a low partial pressure, followed by the burning procedure at elevated temperature, and during this burning procedure the pressure of oxygen can be gradually increased to ensure complete burn off of the binder.

DESCRIPTION OF THE PREFERRED EMBODIMENT

Figure 1:
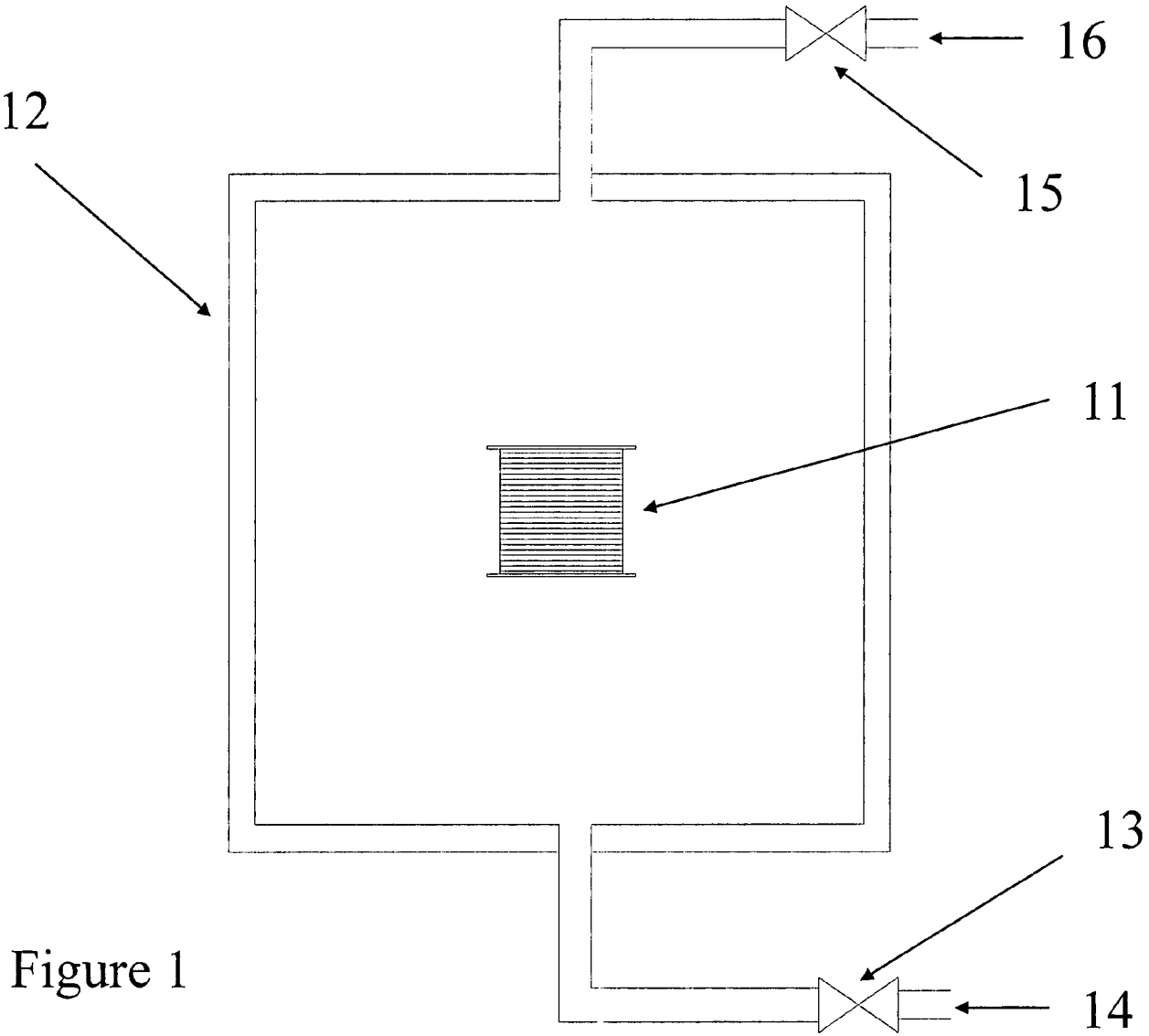
FIG. 1 is a schematic of a furnace for heat-treating the Bi-2212 coil.

A Bi-2212 wire is fabricated by the powder-in-tube or similar process and is insulated with a ceramic-glass yarn insulation. The yarn is applied either by braiding or serving. By necessity the yarn is treated with a carbonaceous organic binder, for example polyurethane resin, to ensure its flexibility and good handling properties. This insulated wire is wound as compactly as possible, creating a wind on a coil former at very high tension with minimum void spaces. Referring to FIG. 1, the coil 11 thus formed is placed in a furnace 12 in a controlled atmosphere, typically air or a mix of gases with at least some partial pressure of oxygen, and heated to burn off the polyurethane resin at some elevated temperature that is below the main superconductor phase reaction temperature. Higher temperatures favor faster removal of absorbed gasses on the various surfaces, but certain specific lower temperatures have shown improvement on $J_c$ of the strand. For Bi-2212, this temperature had typically been 820° C., but we have found 320° C. to be optimum in delivering improved critical current density ($J_c$) results. More generally we deem the range of 250° C.-850° C. to be useful for Bi-2212, with 300° C.-600° C. being preferable. This reaction of the organic binder leaves the coil and interstices of the braid saturated with $CO_2$. The furnace is cooled back down to room temperature and evacuated through a valved 13 port 14 to remove the $CO_2$ and any other contaminant gases. The vacuum system is preferably a dry pump or oil pumped system with necessary traps to ensure that no back streaming of oil can occur. The system is pumped down to a pressure at or below $100\times10^{-3}$ torr, ideally down to $10^{-6}$ Torr for at least 30 minutes to ensure the removal of all the contaminating gasses in the interstices of the winding. The combustion products can be monitored with a residual gas analyzer to determine when all the contaminating products are removed during the evacuation sequence. It is noted that the furnace is not evacuated at elevated temperatures because that has been shown to adversely affect the superconducting properties of Bi-2212.

After the pump-out of $CO_2$ from the system, the furnace chamber is back-filled with oxygen (at an oxygen concentration of from about 20% to 100%, preferably 100%), or the required gas mixture through a valved 15 port 16 and the temperature increased to the transition temperature of the powders to the high current superconducting phase. From this stage, the procedures can be the same as in any conventionally known Bi-2212 coil reaction sequence, typically a peak temperature of from 870° C. to 900° C., with more preferably a peak temperature of ~890° C. with a 5° C./hr cool down to ~830° C. held for 60-100 hours before furnace cooling.

The same procedures as above could be performed on a strand that has $(Bi, Pb)_2Sr_2Ca_2Cu_3O_x$, $YBa_2Cu_3O_x$ or any other RE-123 compound (where RE=Y, Gd, Er, Ho, Nd, Sm, Eu, Yb, Dy, Tm, or Lu), as the superconductor instead of Bi-2212. The important concept is that this technique allows a superconductor that needs oxygen for proper phase formation to have access to oxygen while remaining electrically insulated from adjacent turns. When the superconductor wire is of the $(Bi, Pb)_2Sr_2Ca_2Cu_3O_x$ family, a peak reaction temperature is typically from 870° C. to 900° C. When the ceramic superconductor wire is $ReBa_2Cu_3O_x$, where Re=one of the rare earths Y, Gd, Er, Ho, Nd, Sm, Eu, Yb, Dy, Tm, or Lu, the peak reaction temperature is typically 950° C. to 1050° C.

The invention is further illustrated by the following Example, which is intended to be illustrative of the invention and not delimitative thereof. In this Example, and elsewhere in the specification, the terms "witness sample" and "barrel sample" are usages that are common to those skilled in this art. Basically they refer to a small sample without insulation that is tested in parallel. It can be a straight sample or it can be mounted on the surface of a barrel. Mounting on a barrel surface gives a longer length in the testing region and thus a more accurate measurement. Because these witness or barrel samples do not have insulation, nor are they wound in layers, they don't experience the possible degradation issues that wire in coil form can experience.

Example

Figure 2:
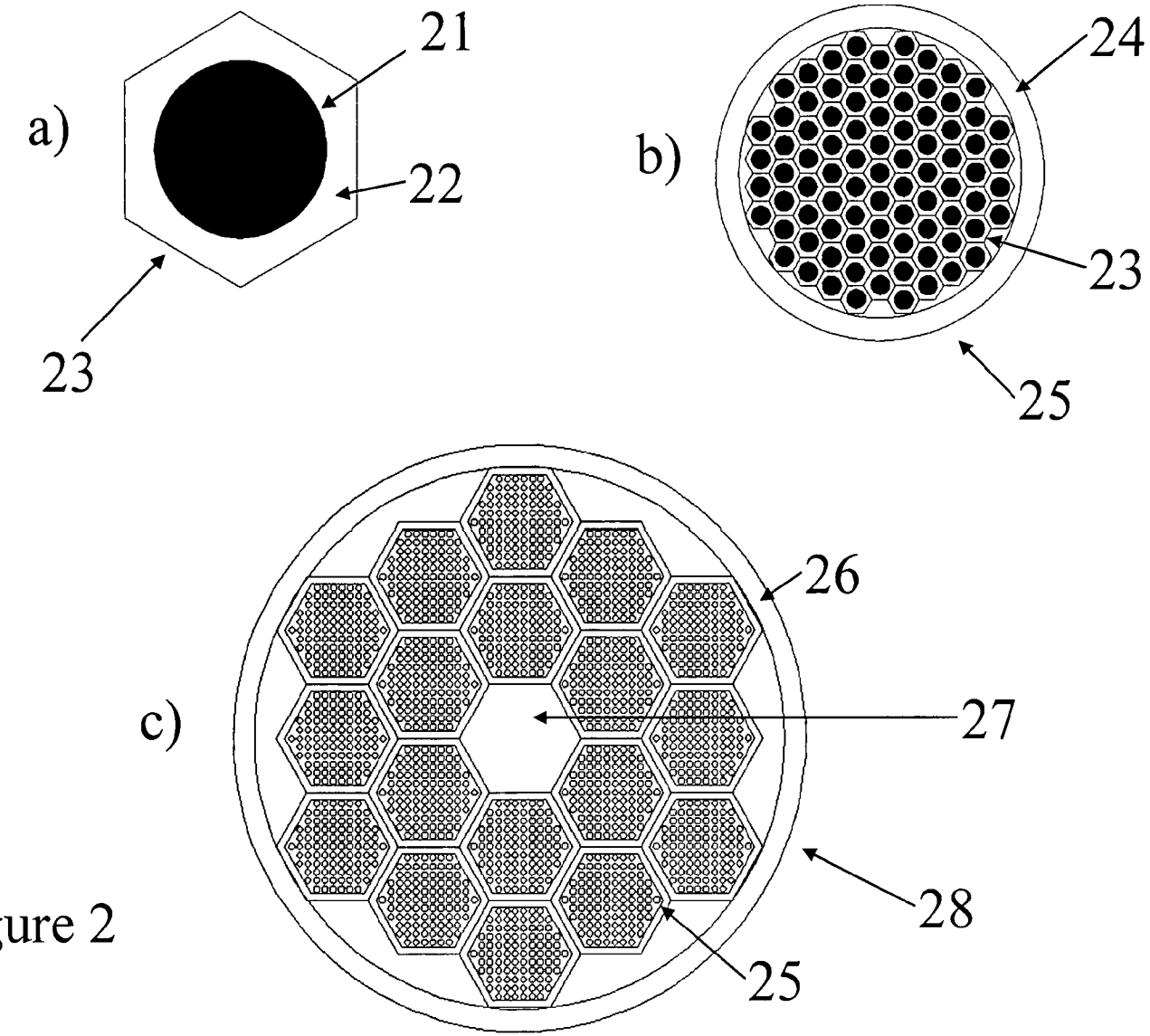
FIG. 2 illustrates the fabrication steps of the Bi-2212 strand.

Bi-2212 precursor powders with cation stoichiometry of Bi:Sr:Ca:Cu of 2.17:1.94:0.89:2.0 made by the melting-casting process were purchased from Nexans SuperConductors GmbH. As per FIG. 2, and described in prior art, the starting Bi-2212 precursor powder 21 was packed in a pure silver tube 22 as per prior art high temperature superconductor powder-in-tube methods. As shown at a) these powder tubes were drawn and hexed to 2.29 mm flat-to-flat (FTF) and cut into lengths of 460 mm forming the mono-core hexes 23. At b) eighty-five of these mono-core hexes were bundled and stacked into another silver tube 24, forming an intermediate restack 25. This intermediate restack was drawn and hexed to 8.05 mm FTF for use in a 7 restack hex or 4.85 mm FTF for use in a 19 restack hex, both in lengths of 460 mm. To improve the wire fabrication, the central superconductor hex in the 19 stack configuration was replaced with a pure Ag hex 27. Thus, at c), 7 or 19 hexes 25 were restacked into a AgMg0.2 wt % alloy tube 26 (referred as 85×7 and 85×19 wire) to form the final restack 28. The restacks were processed using standard wiredrawing techniques to final sizes of 1.0 mm for the 85×7 wire and 1.50 mm for the 85×19 wire. The wires were cleaned of drawing oil with alcohol in preparation for braiding. High alumina ceramic-glass yarn of composition 70% $Al_2O_3$+30% $SiO_2$ and a linear mass density of 67 Tex with polyurethane resin binder was braided onto the wire using the same techniques and machinery used for low temperature superconductors (see Canfer, et al, "Insulation Development for the Next European Dipole", Advances in Cryo Engineering, Vol. 52A, 2006, pp. 298-305). The final braid thickness obtained was about 125.mu.m, with the final post-braided wire diameters were 1.25 mm for the 85×7 wire and 1.75 mm for the 85×19 wire.

A 16 layer coil, with a total of 672 turns, was made from 112 m of 1.50 mm 85×19 wire. The coil was heat-treated in a flowing oxygen atmosphere using a partial melt-solidification process. The coil was annealed in the flowing oxygen gas at 450° C. for 10 hours with a heating rate of 100-150° C./hr., and this cycle was repeated twice to burn off the polyurethane resin binder. After cooling to room temperature the furnace was evacuated to a vacuum of <60 millitorr and held for 2 hours. Then the furnace was back-filled with pure oxygen. The furnace was ramped to a maximum temperature of 889° C. with a ramp rate of 40° C./hr and a cooling rate of 2.5° C./hr to 830° C. where it was held for 60 hours before a furnace cool-down to room temperature. No leakage was found on the coil surface after heat treatment. The coil was able to achieve a supercurrent of 425 at 4.2 K and 5 T applied field before quenching, equivalent to 90% of a 1 m witness test sample.

Figure 3:
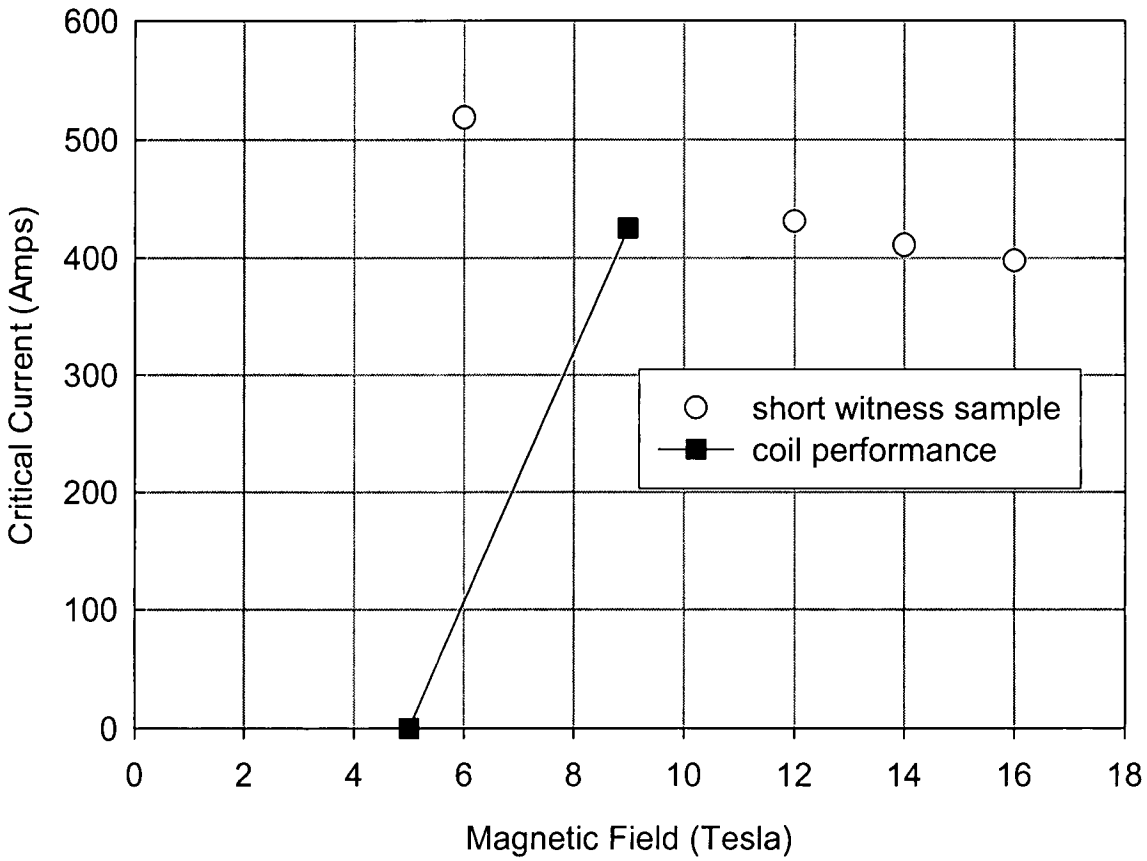
FIG. 3 is a plot comparing the Bi-2212 short sample current vs. field trace, and the actual field generating performance of the magnet made from that strand.

The coil generated 3.98 T in 5 T background field as shown in FIG. 3, quite close to what would be expected from the curve of the short sample results. In comparison, an 8 layer coil (total 447 turns) was made from 52 m of 1.0 mm 85×7 wire without the evacuation and burn out procedures that are the substance of this patent. There were five black spots found on coils after heat treatment. X-ray analysis in an electron microscope indentified the black spots as Bi-2212 that had leaked to the surface. The average critical current ($I_c$) (4.2 K, self-field) of short straight samples cut from each layer of the coil is 430 A, equivalent to just 70% of the 1 m barrel test sample.

The temperature of the pre-reaction sequence needed to burn off the organic component of the braid depends on balancing two major factors. One factor is that the uses of specific temperatures have shown to have significant effects on the short sample $J_c$ of Bi-2212. An experiment on short sample $I_c$ optimization of strand without braid showed that a pre-reaction sequence of 320° C. for 2 hrs. gave ~10-20% higher $I_c$ than a pre-reaction sequence of 820° C. for 2 hrs. The other factor is that outgassing of undesirable gases is enhanced at higher temperatures. So one must balance the need to remove as much organic binder as possible by using high temperatures versus the need to use lower temperatures to optimize the intrinsic $I_c$ of the strand.

While the present invention has been described in terms of specific embodiments thereof, it will be understood in view of the present disclosure, that numerous variations upon the invention are now enabled to those skilled in the art, which variations yet reside within the scope of the present teaching. Accordingly, the invention is to be broadly construed, and limited only by the scope and spirit of the claims now appended hereto.

The invention claimed is:

1. A method for manufacturing high temperature superconducting coils with electrical insulation, comprising in sequence the steps of:

(a) forming an electromagnet coil device from a winding of superconductive precursor powder-in-tube composite round wire, with the wire turns being separated by a ceramic-glass insulation comprised of a mixture of ceramic and glass fibers and a carbonaceous binder;

(b) removing the binder of the ceramic insulation in a burn-off cycle by combustion in an oxygen-containing environment of a heating vessel at an elevated temperature below the partial melting point of the precursor superconducting powder and ceramic-glass insulation;

(c) evacuating the heating vessel at a reduced temperature at about room temperature;

(d) introducing oxygen gas into the vessel; and (e) increasing the temperature in the vessel to the peak reaction heat treatment temperature for forming the ceramic insulated superconducting wire, while said electromagnet coil device is in said vessel.

2. A method in accordance with claim 1, wherein the ceramic superconductor wire is of the $Bi_2Sr_2CaCu_2O_x$ family.

3. A method in accordance with claim 2, wherein the peak reaction temperature is 870° C. to 900° C.

4. A method in accordance with claim 1, wherein the peak reaction temperature is 870° C. to 900° C.

5. A method in accordance with claim 1, wherein the ceramic superconductor wire is of the $(Bi, Pb)_2Sr_2Ca_2Cu_3O_x$ family.

6. A method in accordance with claim 5, wherein the peak reaction temperature is 820° C. to 860° C.

7. A method in accordance with claim 1, wherein the ceramic superconductor wire is $ReBa_2Cu_3O_x$, where Re=one of the rare earths Y, Gd, Er, Ho, Nd, Sm, Eu, Yb, Dy, Tm, or Lu.

8. A method in accordance with claim 7, wherein the peak reaction temperature is 950° C. to 1050° C.

9. A method in accordance with claim 1, wherein the degree of evacuation is to $100\times10^{-3}$ torr or below.

10. A method in accordance with claim 1, wherein the ceramic-glass fiber insulation remains porous during high temperature heat treatment.

11. A method in accordance with claim 10, wherein the ceramic-glass fiber insulation is made with alumina.

12. A method in accordance with claim 11, wherein the alumina fiber is 70% $Al_2O_3$+30% $SiO_2$.

13. A method in accordance with claim 10, wherein the carbonaceous binder is a polyurethane resin.

14. A method in accordance with claim 1, wherein step (b) is conducted in the range of 250° C. to 850° C.

15. A method in accordance with claim 1, wherein step (b) is conducted in the range of 300° C. to 600° C.

16. A method in accordance with claim 1, wherein the evacuation cycle is repeated one or more times.

17. A method in accordance with claim 1, wherein the oxygen gas concentration is from 20%-100%.

18. A method in accordance with claim 1, wherein the process of burning of the binder insulation occurs by first evacuating the chamber of the initial furnace gas, which may be nitrogen, air, $CO_2$, or some combination thereof, and then back-filling with a gas with oxygen, followed by the burning procedure at elevated temperature.

19. A method in accordance with claim 18, wherein the evacuation, refill with oxygen and burn-off cycle is repeated one or more times.

20. A method in accordance with claim 18, wherein the back-filling of oxygen is initially oxygen of a low partial pressure, followed by the burning procedure at elevated temperature; and wherein during this burning procedure, the pressure of oxygen is gradually increased to ensure complete burn-off of the binder.

21. A method in accordance with claim 1, wherein the combustion products are monitored with a residual gas analyzer to determine when all the contaminating products are removed during the evacuation sequence.

22. A method in accordance with claim 1, wherein the wire is braided with the ceramic-glass insulation.

* * * * *